US006204762B1

(12) United States Patent
Dering et al.

(10) Patent No.: US 6,204,762 B1
(45) Date of Patent: Mar. 20, 2001

(54) REMOTE GUARD-PRESENCE SYSTEM WITH ADJUSTABLE EFFECT AND PROCESS OF USING

(76) Inventors: John P. Dering, 4643 Pimenta Ave., Lakewood, CA (US) 90712; James A. Wes, 3263 Bent Twig La., Diamond Bar, CA (US) 91765; John F. Spadaro, 17072 Sims St., Apt. B, Huntington Beach, CA (US) 92649; Jay B. Cleckler, 40 Nieto #6, Long Beach, CA (US) 90803; Genyvieve A. Donne, 1612 Dalmatia Dr., San Pedro, CA (US) 90732; William E. Hutchinson, 6303 N. Marina Pacifica, Long Beach, CA (US) 90803

( * ) Notice: Subject to any disclaimer, the term of this patent is extended or adjusted under 35 U.S.C. 154(b) by 0 days.

(21) Appl. No.: 09/436,875

(22) Filed: Nov. 9, 1999

Related U.S. Application Data

(60) Provisional application No. 60/108,879, filed on Nov. 17, 1998.

(51) Int. Cl.[7] ..... G08B 13/00

(52) U.S. Cl. ..... 340/541; 340/540; 340/692; 340/384.3; 348/152

(58) Field of Search ..... 340/541, 540, 340/692, 564, 384.3, 573.1, 566, 565; 348/152, 153, 154, 155, 565; 342/27

(56) References Cited

U.S. PATENT DOCUMENTS 4,651,143 * 3/1987 Yamanaka ..... 340/691
4,857,912 * 8/1989 Everett ..... 340/522
5,657,076 * 8/1997 App ..... 348/154
5,786,760 * 7/1998 Suzuki et al. ..... 340/541

* cited by examiner

*Primary Examiner*—Jeffery A. Hofsass
*Assistant Examiner*—Anh La
(74) *Attorney, Agent, or Firm*—John J. Murphey

(57) ABSTRACT

An apparatus for achieving remote guarding of an area with adjustable effect on unauthorized entrants, comprising an operator station including a signal receiver with television display, radiant energy selection control, and energy level controller, a first sensor means placed about the area for detecting the presence and movements of entrants to the area, the visual effects of later radiation directed toward them, and generating signals in response thereto, a source of radiant energy including at least one transmitter of the energy for broadcasting the energy into the area, upon selection of the type of radiant energy from the selection control, and of a level controlled by the energy level controller, the radiant energy of a nature and intensity capable of varying in strength and duration as to cause different observable effects on intruders present in the area who do not leave the area upon command, second sensor means placed about the area for detecting the onset of and intensity of the radiant energy broadcast into the area and generating signals in response thereto, first transfer means for transferring the generated signals from the first sensor means and separately transferring the generated signals from the second sensor means to the signal receiver in the operator station to allow the operator real-time observation of the area. and second transfer means for transferring control signals from the operator station to the radiant energy source and transmitter to vary the type and intensity of the radiant energy broadcast into the area to prevent further intrusion into the area.

32 Claims, 3 Drawing Sheets

REMOTE GUARD-PRESENCE SYSTEM WITH ADJUSTABLE EFFECT AND PROCESS OF USING

RELATIONSHIP TO OTHER APPLICATIONS

This application relates to our previously filed Provisional Patent Application titled "REMOTE GUARD-PRESENCE SYSTEM WITH VERNIER EFFECTS" carrying a filing date of Nov. 17, 1998, and a Ser. No. of 60/108,879.

BACKGROUND OF THE INVENTION

1. Field of the Invention

This invention relates to the business of facility protection of the general type where a patrolling guard or other means is used to discourage unauthorized entry, passage through restricted areas, unauthorized interactions, unauthorized removal of assets (property) or unauthorized exit. More specifically, it pertains to an integrated system which allows a guard, at a remote location, to project force against unauthorized parties who trespass into the protected area, and to project adjustable and observable levels of such force in order to inflict only that level of effect deemed necessary to accomplish the protection or intervention or incarceration objective.

2. Description of the Prior Art

The classic solution for facility protection is a manned guard force patrolling the protected region or area and its approaches. This is manpower-intensive and puts the guard or guards at significant risk. It also has historically provided the same intensity of protection over the entire area to be protected notwithstanding that some portions of the area (called the "vital" area) may require more protection than other portions.

Secured and locked facilities, involving physical barriers, such as walls and fences, and controlled access, such as doors and gates, have been used to augment the guards, or sometimes to replace them. Remote detection, such as trip wires, heat sensors and light beams, have been employed to extend the area and number of approaches that a limited guard force can patrol, by focusing their attention on the known anomalous condition. However, these can be subject to false alarms and they provide no immediate method for countering the threat.

Manned remote detection using viewing systems, such as telescopes and closed circuit television, have been employed to allow human discernment from a remote location. However, while this reduces false alarms, it still provides no immediate method for countering the threat. Further, these remote detection systems invariably are visible to the intruder and are easy targets for disablement prior to entering the guarded area.

Alarm systems, such as flashing lights and sirens, have been used to convey to unauthorized persons that they are acting beyond the parameters and protocols established for the protected facility. However, these are low-power devices and are often ignored by an intentional belligerent. Further, these devices usually precede later entry by guards thus providing a time delay wherein the intruder can increase the threat to the guarded area such as by further intrusion or by stationing others to repel the guards. This calls for more manpower which raises the cost of protection.

Extended reach weapons, such as guns, police clubs and water hoses, have been used to allow guards to enforce their intention while maximizing distance or exposure to the unauthorized persons, to minimize the guard's risk of injury and/or overcome a numerical superiority. However, such weapons require a heightened degree of skill on the part of the guard and the acquisition of financial insurance to ameliorate the effects of property damages and personal injuries caused by negligent, wrongful or excessive use of the weapons.

Some means, however, have been used in a variety of ways, such as karate, choke holds, Mace®, tear gas, etc., which are intended to provide the guard force with incremental levels of a rebuffing force, termed an "adjustable" effect. Except for the case of "hands-on techniques", such as choke holds and karate, most adjustable techniques are prone to a broad range of undesired outcomes such as missing the intended suspect altogether, hitting a more vulnerable area of the suspect than desired, hitting a bystander or damaging the asset the guard is trying to protect.

Remote release of inhibiting agents, such as chemical gas or guard dogs, have been used to interdict unauthorized personnel while significantly limiting the guard's exposure. Such remote agents historically tend to be non-selective and difficult to control, i.e. they are non-adjustable. In addition, these inhibiting agents may cause undesirable effects on the intruder, such as a debilitating injury or death, that could bring about litigation for negligent use of these protection devices. Further, inhibiting agents may persist in the area, complicating entry by guard forces who may be dispatched to secure the area. Finally, such remote agents could contaminate the controlled area or, even worse, leave the controlled area and achieve undesirable collateral effects, including residual contamination.

In addition, there are numerous instances where a variety of types or intensities of protection are required. For instance, in an area leading up to a door way, on the other side of which is located a vital asset to be protected, the general area away from the door may require a first level of protection, merely to thwart innocent trespassers, whereas the area immediately in front of the door may require a second and greater level of protection to stop intentional trespassers. Once the entrant passes through the door, the ability to protect the asset is gone forever.

On approaching the door, exposure to increasing protective force may be controlled to increase the protective energy to which the entrant is exposed thus increasing the protective nature surrounding the door. The final measure of protection is where the entrant reaches the door only to succumb to the energy adjacent the door. Therefore, it is imperative that the highest level of protection be located at or near the door.

SUMMARY OF THE INVENTION

This invention is a new and novel remotely controlled and directed apparatus weapon for integration with traditionally secured facilities, remote detection devices, closed circuit TV, and a remotely-located, manned control station. It is capable of joinder with other, more conventional, security weapons and security feedback sensors to provide a broader range of security to a facility that can handle a wider range of possible belligerents or intruders. This integrated system will allow the person at the operator station, or their supervisor, to interdict an entrant, trespasser, intruder, or belligerent (hereinafter "intruder") by exerting a wide range, and a more adjustable level, of preventive force and have it more accurately delivered to the intended target than is available under the prior art.

This invention is an apparatus and method of using the apparatus for achieving remote guarding of an area with adjustable effect on unauthorized entrants, comprising an operator station remotely located from the area to be guarded, a first sensor means placed about the area for detecting the presence and movements of intruders to the area and generating signals in response thereto, at least one source of radiant energy for broadcast into the area, upon command from the operator station, the radiant energy capable of varying in strength and duration as to cause different observable effects on entrants present in the area, a second sensor means placed about the area for detecting the onset of and intensity of the radiant energy emitted into the area and generating signals in response thereto, a first transfer means for transferring the generated signals from the first sensor means and the generated signals from the second sensor means to the operator station, a second transfer means for transferring signals from the operator station to the radiant energy source to vary the type and intensity of the radiant energy broadcast into the area, a means for receiving the signals from the first and the second sensor means and displaying them to the operator in the station to monitor the location of the intruders in the area and the effects of the broadcast energy on them, and a means for controlling, from the operator station, the strength and duration of the radiant energy broadcast into the area to vary the effects on intruders from mild discomfort to gross tissue injury. In another embodiment of the invention, a plurality of areas to be guarded are arranged to be monitored by a guard manning a guard station whose display of intruders and control of the type and intensity of radiation into the area is shared or controlled through hierarchical supervision so that one or a few highly skilled operators can control the higher levels of radiation broadcast in numerous protected areas and share their supervision with many areas to provide the skill of control at a momentarily efficient level.

This invention provides reliable selection of the level of force, confident direction and adjustment of force, by measuring the extent of the force and by observing its effect on the entrant, and protecting the guard from risk from the intruder. The effects of this system may be remotely controlled by a guard removed from the guarded area, either in or out of sight of the area. Superior control may be exercised over a plurality of remotely located guards, so that one highly skilled person or controller may control a wide assortment of guards and, hence, guarded areas. The guard need not be adept at physically protective aptitudes as radiant energy replaces the hands-on guard requirement thus lowering the cost of protection. As there is no known common term for such a system, it is hereby referred to as a "Remote Guard-Presence System with Adjustable Effecft".

The level of protection of the area in question may be adjusted by the guard in the remote operator station, or by the guard's superior, in accordance with measurements of the energy injected into the area supplemented by observations of the effects of the injected energy upon the intruder and the closeness of the intruder to the vital or central area or asset to be protected. Further, such adjustment of the level of protection may be achieved automatically by arranging increasing levels of energy to be radiated at locations closer to the vital or central area to be protected. In this fashion, as the intruder approaches the vital area, the energy against him or her may be increased to the point that further approach is discouraged. Still further, the type and intensity of the broadcast energy may be used to drive the intruder away from the area to be protected thus insuring the security of the area without the complications of latent injured or dead bodies in the area.

Accordingly, the main object of this invention is an apparatus for installation in and about an area or about an asset to be protected that is highly controllable from a low power setting, where the attention of the intruder is obtained and a simple warning issued, through an intermediate power setting where the area is charged with energy that produces annoying but safe levels of power to the intruder, in an effort to force the intruder to leave the area, to higher power levels that can cause irreversible damage to the intruder and render him/her incapable of further activity in the area while at the same time providing an off-premises guard with a complete view of the premises, real-time evidence of the amount of energy broadcast into the area and its effects on the intruder, and a means of varying the broadcast energy to either prevent the intruder from continuing his/her evasive tactics or driving the intruder from the area, all while supervised by a highly skilled person singly or in a tiered management organization that provides knowledgeable and skilled control over the area to be protected.

Other objects of the invention include an apparatus that is useful in stopping intruders to a protected area that does not require a heightened degree of combat skill on the part of the area guard, an apparatus that is adjustable in power level to radiate only that level of power to cause sufficient detriment to the intruder to force him/her to leave the area, an apparatus that delivers power to the protected area in real time so that no effects thereof linger beyond the actual broadcast period thus eliminating contamination problems, and an apparatus that may be installed in such a way as to provide for increasing levels of radiation as the vital portion of the area is approached.

These and other objects of the invention may be determined by reading the description of the preferred embodiments along with the drawings attached hereto. The scope of protection sought by the inventors may be gleaned from a fair reading of the claims that conclude this specification.

DESCRIPTION OF THE PREFERRED EMBODIMENT

Figure 1:
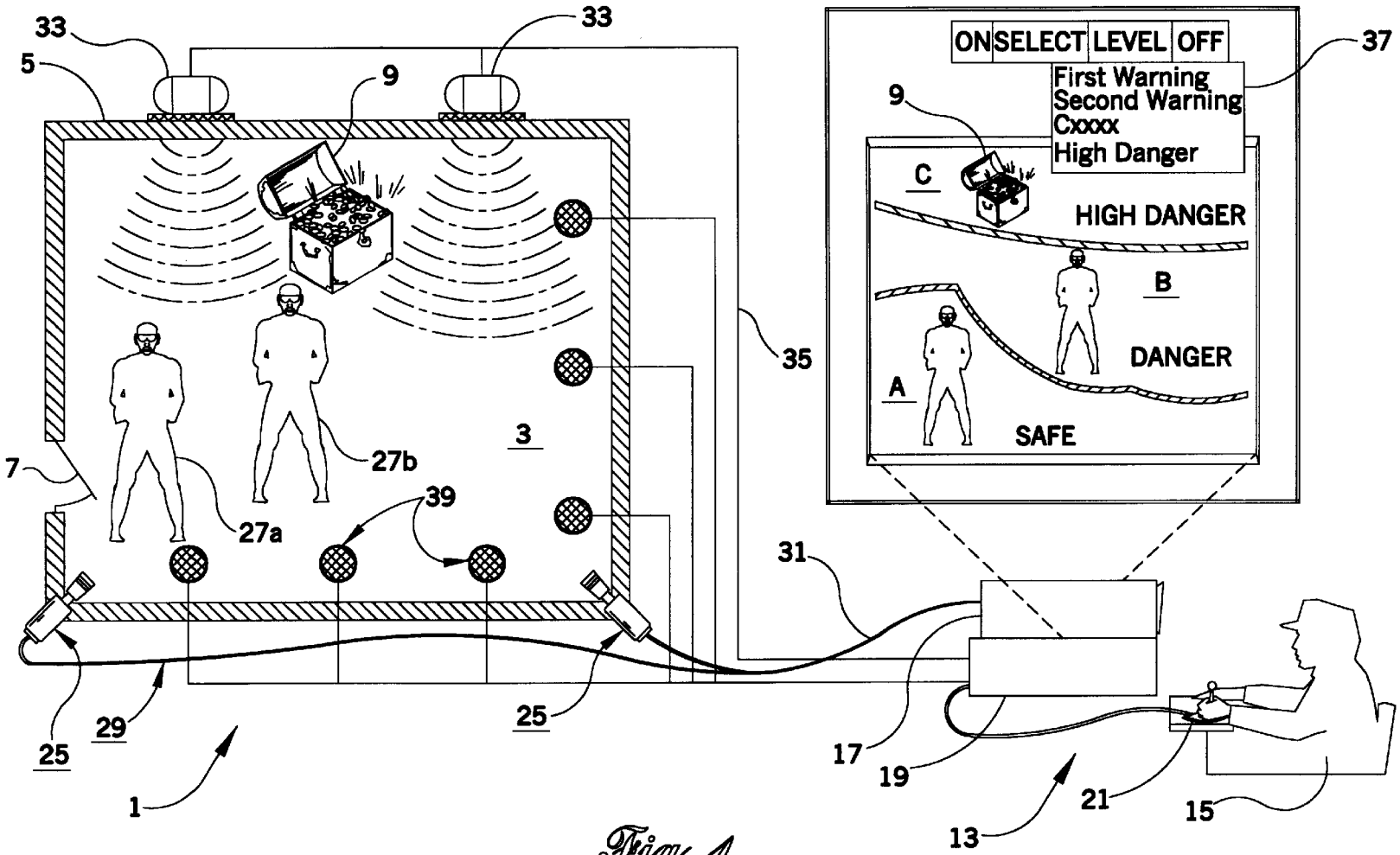
FIG. 1 is an illustrated view of a secured area with two individuals, shown in cartoon form, having intruded into the area protected by the apparatus of this invention; and, FIG. 2 is another embodiment of the invention showing a plurality of such secured areas each overseen by an operator where the operators are under supervision of a higher tiered operator.

Turning now to the drawings wherein elements are identified by numerals and like elements are identified with like numerals throughout the two figures, in FIG. 1 is shown the apparatus 1 of this invention for achieving remote guarding of an area 3, said area defined by one or more outside borders 5, with an authorized entrance 7 thereinto and containing an asset 9, located within area 3 and which is the subject of a controllable plan of protection.

An operator station 13 is shown, preferably remotely located from area 3, preferably manned by a human operator 15, and containing equipment, such as a signal receiver with television display 17, to monitor area 3, and a selection console 19 leading to an energy intensity controller 21 . In some instances, operator station 13 is located so remote from area 3 as to not be visible to entrants to said area. This may be necessary where it is desired not to have the area publically known as a guarded facility.

A plurality of first sensor means 25 are shown placed about area 3 for detecting the presence and movements of intruders 27*a* and 27*b* into the area and generating signals in response thereto. Examples of first sensor means 25 shown usable herein include television cameras, motion sensors, heat sensors, microphones, and pressure transducers. While television cameras are best operable during hours of daylight or in well-lit areas, motions sensors are best operable during hours of darkness, and heat sensors and pressure transducers are useful in both daylight and dark areas. Pressure transducers have the additional advantage of operation independent of atmospheric and light conditions; however, they require the entrant to pass close to the device to place physical pressure on the transducer. Generally, a mix of these devices make for optimal presence confirmation.

A first transfer means 29 is provided for transferring the signals generated from first sensor means 25 to operator station 13 and into signal receiver 17. Such means as audio transfer lines, video transfer lines, and fiber optics (all identified as "lines" 31) are contemplated herein as well as transmitting antennas (not shown) for broadcasting from area 3 and receiving antennas (also not shown) at operator station 13 for receiving signals from the transmitting antennas as is already known in the art.

A source of the energy (not shown) including at least one transmitter 33 of controllable radiant energy, is provided for radiating into area 3 upon command from operator station 13 through selection console 19, energy level controller 21, and second transfer means 35. The energy source may be a tank of highly compressed gas, a steam boiler, a high voltage electric transformer, a motor-driven siren, a bank of batteries, etc. and these are generally known in the prior art. To quality as acceptable radiant energy sources, the source should be capable of intensity control (volume control in the case of acoustic energy) and capable of being transmitted in a variety of strengths and durations so as to cause different effects on intruders. The choices of radiant energy may be selected by operator 15 from a menu 37 that is shown being displayed on the television monitor associated with signal receiver 17 while the level of intensity may be controlled through energy level controller 21 manipulated by operator 15. Energy transmitter 33 may take a wide variety of forms such as pole-mounted and fence-mounted loud speakers, whistles, sirens or antennas, and partially buried forms of the same devices. While each transmitter 33 is preferably directed into area 3, in some cases, it is desirable to aim two transmitters toward each other so that their combined radiations produce a significantly greater overall radiation with more severe effects on the intruder. Generally, second transfer means 35 takes the form of shielded cable, preferably buried underground, running from a signal generator (not shown) through energy level controller 21 to transmitters 33.

A plurality of second sensor means 39 are shown placed about area 3 for measuring the intensity of the radiation broadcast into area 3 from transmitter 33 and generate signals in response thereto. A wide variety of second sensor means 39 may be employed such as audio receivers and non-audio radiant energy receivers. An important reason to provide second sensor means 39 is that the radiation effects on the intruders may vary depending upon the physical size of the intruder, the clothing or other protective gear worn by the intruder, and the training of the intruder, i.e., has he or she been trained to resist such radiation. For instance, a thin person may react to a given level of radiation differently than a heavy person. An intruder wearing ear plugs, ear phones, or energy absorbing clothing may resist certain levels of radiation. A belligerent intruder may be trained to cover his or her ears with their hands or shield their eyes in order to avoid certain levels of radiation. If the measured level of radiation is shown by prior testing to have a certain effect on an individual and the observable effect on the individual is unlike that, this would suggest to the operator that the intruder is wearing some sort of radiation protection. This should have a great influence on later decisions as to the type of energy, mix of energies, and intensity levels to later broadcast into the protected area to maximize the effects of the radiation on the intruders. All of these efforts to avoid the effects of radiation mean that the controller must use independent thought to first know the expected effects of the radiation, and secondly, by visual monitoring, learn which of the intruders are using some protective device to avoid the effects. Without this knowledge, the operator must wait for an objective act of the intruder, such as falling down or otherwise collapsing, before the intensity is shown to produce the effect desired. By that time, the effect may be so severe as to fatally injure the intruder rather than to drive him or her away from the protected area.

First transfer means 29 is designed to separately convey to signal receiver 17 the signals generated from second sensor means 39 located in operator station 13. As will be disclosed later, in a separate embodiment, first transfer means 29 may be programmed to convey signals from first sensor means 25 and second sensor means 39 to other signal receivers 17 such as another receiver located in the office of a supervisor of human operator 15 so that, when certain levels of high intensity radiation are called for, to stop a continuing intruder, additional management may be utilized to insure the extra radiation is within protocol limits established for that protected area 3.

The primary transmitter 33 of radiant energy include loud speakers, whistles, and sirens. These transmitters are characteristically designed to emit sound waves that affect the ears of the intruders. Loud speakers can provide the initial notification that the person is an intruder and has entered an unauthorized area. Whistles and sirens may provide the same function but must rely upon their noise generation to provide an implied message that a trespass has occurred. However, loud speakers, whistles, and sirens may also be used to radiate huge amounts of energy into the area that can overwhelm the person's hearing system and inflict significant damage to ear drum tissue and cranial nerves. These devices may be driven by compressed air, steam, electricity, and such other forms of energy.

Different forms of radiant energy are contemplated in this invention such as acoustic energy, radio frequency (RF) energy, microwave energy, laser energy and X-Ray radiation. Massive amounts of acoustic energy are efficient at stopping intruders and, when the level is raised enough, can cause rupture of internal organs; RF energy in large amounts, microwave energy, hi-power lasers, X-rays, can cause a variety of effects on humans, from general feelings of uncomfortableness to severe burning and rupturing of human tissue. Extreme doses of these types of energy can terminate human life. Mixing these forms of energy in the apparatus previously disclosed herein produce powerful weapons whose results on the human body can be varied from annoyance to termination of life by simply varying the amount of energy applied to transmitter 33. These forms of energy have the additional advantage of total or near total attenuation upon cessation of the transmission or radiation. Thus, no lasting or residual contamination remains in the protected area and personnel can enter the area immediately upon termination of the radiation. Still further, by combining these different forms of radiant energy with transmitters 33 aimed in different and varying directions, the operator (or his or her supervisor) can vary the level of radiation to various portions of area 3 so as to drive an intruder out of the area without causing fatalities. However, in the case of the belligerent intruder, the level of radiation may have to be increased until further intrusion is quickly and unequivocally terminated.

FIG. 1 also shows that area 3 may be divided into established areas, each with its own level of required radiation intensity. An intruder passing from one area into another may invite an increased level of radiation directed at him or her to clearly indicate moves from one portion, he or she will be pass into an area dominated by a different and possibly higher level of radiant energy. These different levels of radiation are almost immediately made known to the intruder through his or her body's reaction to the increased level of radiation. For instance, a simple sounding siren followed by a message broadcast over the loudspeaker in first safe portion "A" of light or limited protection will indicate to the intruder that he or she has trespassed into a protected area and should leave immediately. This would generally cause an innocent entrant to turn around and leave the premises.

On the other hand, a belligerent intruder would more than likely ignore the warning and proceed through area portion "A" to another portion "B", nearer to vital asset 9, that carries a medium or higher level of protection. In doing so, the intruder would pass into a portion of area 3 that carries a greater dose of radiant energy. The level of radiant energy in this portion may be such that it causes damage to the ears of the intruder and causes him or her to double over with pain. This should discourage all but the most intensely focused intruder who may continue forward toward asset 9 and pass into third portion "C" of area 3 that is closest to asset 9. In this portion "C", the type and level of radiation is of such quantity that the intruder will suffer debilitating injury and possibly death.

In another use of this apparatus, the various zones A, B, and C are either non-existent or variable according to the topography, geography, weather and other conditions existing at the time of the intrusion. In this situation, operator 15, after observing the presence of the intruders, may select a type of energy and a level of radiation that will gain the attention of the intruders and provide them with a message that they should immediately leave the area and possibly give them directions to the exit. Should the intruders fail to heed the warning, operator 15 may increase the intensity of the broadcast energy and direct the transmission from one or more of transmitters 33 to "herd" the intruders toward the exit. By lowering the intensity of the broadcast energy at one or more transmitters 33 and raising the intensity of the broadcast energy at other of transmitters 33, operator 15 can drive the intruders toward areas of lesser intensity radiation and, ultimately, out exit gate 7.

Figure 2:
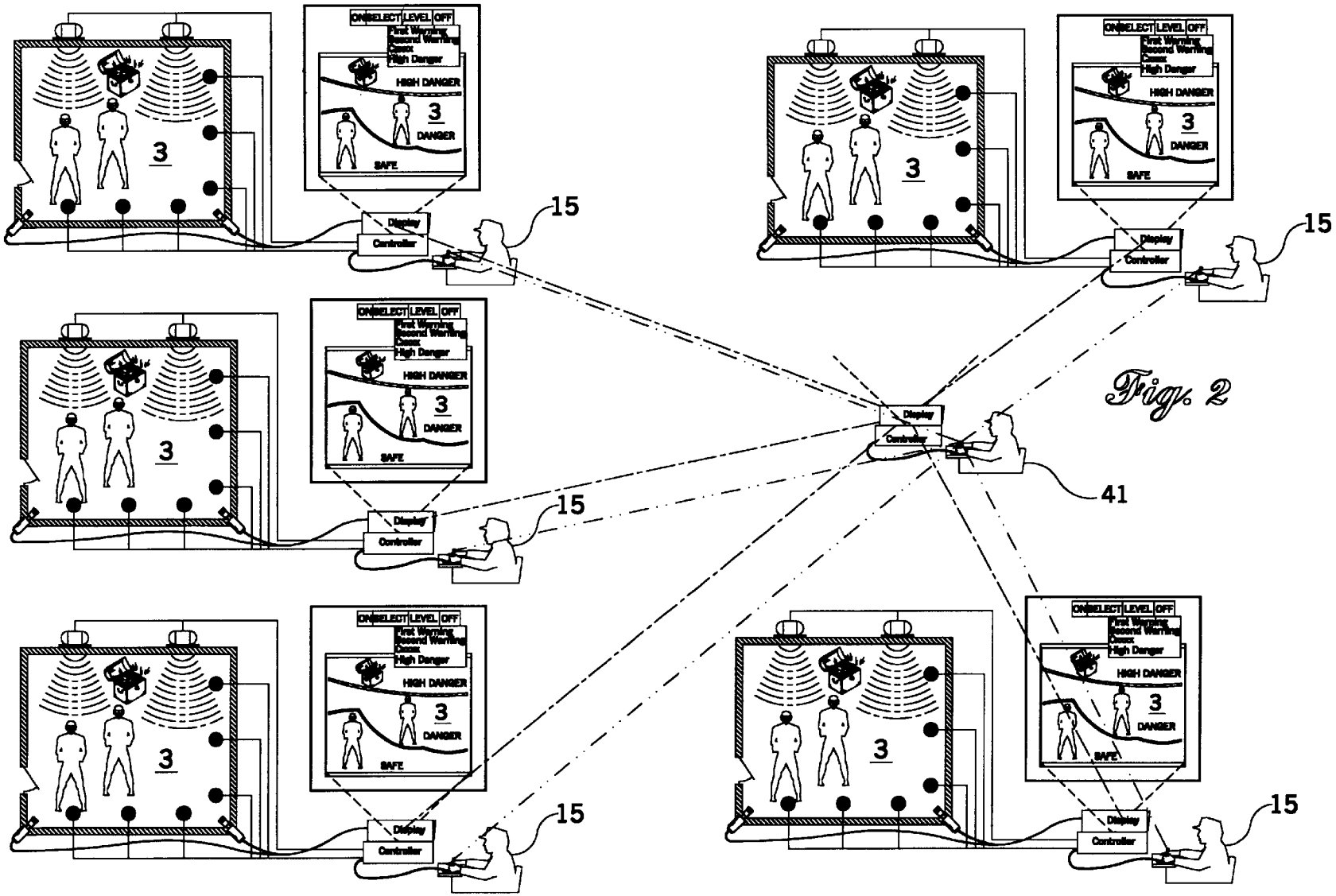

As shown in FIG. 2, numerous areas of protection 3 may be arranged in tiered or hierarchical form and each controlled by an operator 15, much like the apparatus shown in FIG. 1. In this embodiment, however, the maximum intensity of radiation available to operator 15 is restricted to a level below that capable of causing fatal injury to the intruders. A singular supervisor 41 is placed in contact with all operators 15 and, only in cases where the intruders show their belligerence by continuing their intrusive behavior following radiation into the area measured by second sensor means 39 to be causing discomfort to them, supervisor 41 takes over control of energy level controller 21 and determines the next course of action in that area. This embodiment allows operators 15 to be of average intelligence and use one highly skilled operator (supervisor 41) to spread his or her heightened abilities over a plurality of protected areas 3 to lower the cost of overall operation of the apparatus. Control by supervisor in this embodiment may be performed over the Internet with coded discourse between the operators.

Figure 3:
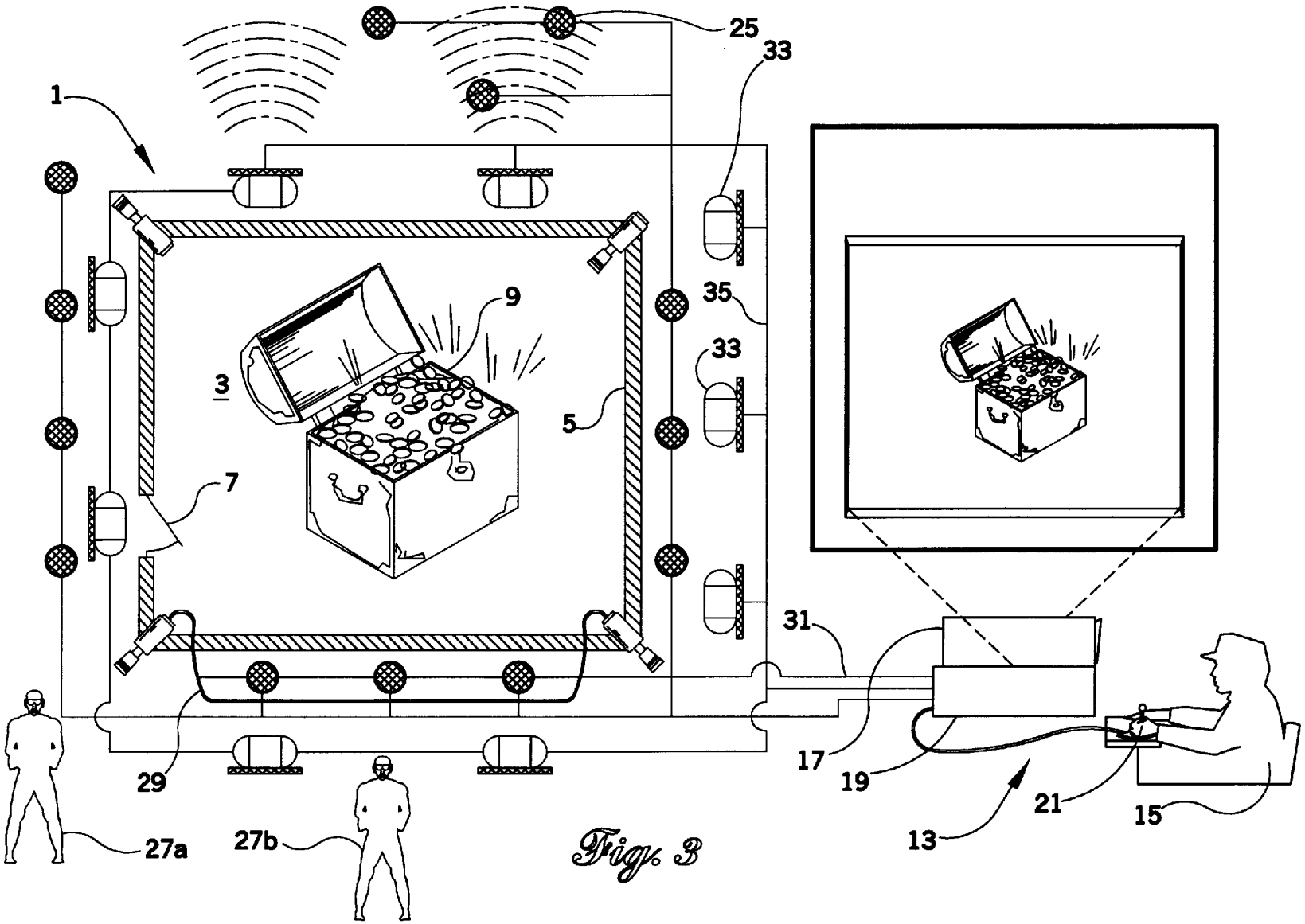
FIG. 3 is another embodiment of the invention where the apparatus is "turned outward" to protect a border about an area and/or an asset located therein by preventing intruders from entering the area in the first place.

FIG. 3 shows still another embodiment of invention 1 where the apparatus is "turned outward" to protect border 5 about area 3 and/or an asset 9 located therein by preventing the intruders from entering area 3 in the first place. As shown, operator station 13 is still located outside area 3, however, in this instance, station 13 could be located inside area 3 with operator 15 located therein. The same equipment, namely signal receiver with television display 17, selection console 19 and energy level controller 21 would also be located inside station 13 for use by operator 15 or through joint use and control by supervisor 41 should this embodiment be subject to tiered or hierarchical control as was previously discussed with respect to FIG. 2.

First sensor means 25 are now arranged to determine the presence and movement of potential intruders, as opposed to actual intruders, outside area 3 and thus are directed outside border 5. However, means 25 can be located either outside border 5 or inside thereof and performance of this function would be unaffected. The reason for locating first sensor means inside area 3 is to insure the safety of the equipment making up means 25 against damage by belligerent intruders. First transfer means 29 and lines 31 would be located where necessary to deliver the signals to operator station 13.

Transmitters 33 are now located outside border 5 and face outward therefrom. However, just as means 25 can be located both outside and inside area 3, also transmitters 33 may be located in the same order. Second transfer means 35 also is located as shown in FIGS. 1 and 3 to transfer energy to transmitters 33. When operator 15 receives signals form first sensor means 25 and observes potential intruders 27*a* and 27*b* approaching border 5, he or she can select a message to be broadcast through transmitters 33 warning them to leave the area. If the intruders approach closer, operator 15 can select a warning type of energy, such as acoustic energy, and a level that is uncomfortable to humans and cause it to blast or radiate from transmitters 33 outward to warn off the intruders. Should this not drive them away, either operator 15 or supervisor 41 may command a higher level of energy, or a different type of energy, or a mixture of energies, and command them to radiate from transmitters 33. Such an operation can be increased in intensity until the intruders are actually turned away or rendered helpless in place.

In operation of this inventive apparatus as shown in FIG. 1, operator 15 in operator station 13 may detect intruders through operation of first sensor means 25 and then observe the intruders in area 3, institute a first, lightly energetic message into area 3 advising the entrants of the trespassing nature of their positions and advise them to immediately vacate the area. Should the operator observe the persons leaving area 3, he or she has accomplished the task of warning off the intruders.

However, should the entrants ignore the warning from the operator and remain in area 3, or move about area 3 without an indication they are exiting therefrom, the operator can remotely increase the level of radiant energy emitted to transmitters 39 and observe the effects such as doubling over with pain, holding their ears to shut out the noise. This change in radiation may be initiated by operator 47 even without the intruders moving from one portion "A" to portion "B" or "C" so that the operator has a great opportunity to meet a wide variety of situations and not depend on formalistic procedures. All this activity can be monitored by the operator while in a location remote from area 3 so that he or she does not become involved with the intruders. Finally, should these two levels of radiation not persuade the intruders from leaving area 3, the operator may increase the radiation to a level that would disarm the entrants and render them unconscious. The operator then can immediately turn off the radiation and signal a guard force to enter area 3 without fear of injury from radiation or other lingering effects.

Combinations of different forms of radiant energy, such as acoustic energy and radio frequency (RF); acoustic energy and microwave energy, acoustic energy and X-Ray energy; infrared (IR) energy and laser energy, radio frequency (RF) energy and X-Ray energy; and radio frequency (RF) energy and infrared (IR) laser energy and other combinations, at controlled levels of intensity, are contemplated herein.

In the process of using this inventive apparatus, the operator undertakes the steps of (1) remotely inventorying the area to be protected, through visual and non-visual sensor means, to detect the presence of entrants into the area to be protected; (2) checking to see if the entrants are authorized to be in the area; (3) in the case where the entrants are not authorized to be in said area and thus are intruders, remotely activating a first, low level of radiant energy through transmitters located in and about the area nearest the intruders to inform them that they have passed into a restricted area and directing them to leave the area immediately; (4) continuing to monitor the intruders to detect if they have left the area or are in the process of leaving; (5) in the case where the intruders have not left said area or are not moving toward the exit, remotely activating a second, higher level of radiant energy through transmitters giving them additional warning and simultaneously monitoring the level of energy broadcast in the area so as not to injure those intruders who are moving toward the exit; (6) continue to monitor the presence of the intruders; and, (7) if the entrants have not left the area or are otherwise remaining in the area, then either remotely activating a third, devastating level of radiant energy, or obtaining supervisor permission to do so, or notifying the supervisor to remotely activate the energy, through transmitters located in the area nearest the intruders, to render them helpless and summoning guards to enter the area, following cessation of radiation, to inspect the intruders for signs of life and capture those remaining alive.

In the case of belligerent intruders who indicate their intent to remain in the area and attempt to capture the asset or otherwise inflict damage in the area, the process is changed to bypass steps 3, 4, 5 and 6 and, following the warning message without movement of the belligerents toward the exit, immediately release a devastating level of radiant energy into the protected area (or away from the protected area with respect to the embodiment shown in FIG. 3 and previously described) to render them helpless.

The simplicity of the method outlined above is inventive in itself. The fact that only one operator is used to protect an area of varying size depicts the conservation of manpower. The fact that one highly skilled supervisor can control a large plurality of areas through the use of first operators for each area with limited ability to institute harsh measures makes for an extremely safe operation and low operating costs. Further, the fact that a plurality of guards are called to the area only after the entrants have been rendered motionless by the radiant energy reduces the need for a large group of individuals carrying a large cache of weapons that, in and of itself, could cause damage to innocent persons and surrounding property. All of these factors show the inventiveness of the process of using the inventive and novel apparatus of this invention.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. Apparatus for achieving remote guarding of an area with adjustable effect on unauthorized entrants, comprising:

a) an operator station including a signal receiver with television display, radiant energy selection control and energy level controller;

b) first sensor means placed about the area for detecting the presence and movements of entrants to the area, the visual effects of later radiation directed toward them, and generating signals in response thereto;

c) a source of radiant energy including at least one transmitter of the energy for broadcasting said energy into the area, upon selection of the type of radiant energy from said selection control, and of a level controlled by said energy level controller, said radiant energy of a nature and intensity capable of varying in strength and duration as to cause different observable effects on intruders present in the area who do not leave the area upon command;

d) second sensor means placed about the area for detecting the onset of and intensity of the radiant energy broadcast into the area and generating signals in response thereto;

e) first transfer means for transferring said generated signals from said first sensor means and separately transferring said generated signals from said second sensor means to said signal receiver in said operator station to allow the operator real-time observation of the area; and, f) second transfer means for transferring control signals from said operator station to said radiant energy source and transmitter to vary the type and intensity of said radiant energy broadcast into the area to prevent further intrusion into the area.

2. The apparatus of claim 1 wherein said operator station is located so remotely from the area to be guarded as to not be visible to entrants in the area.

3. The apparatus of claim 1 wherein said operator station is located remotely but within visual range of the area to be guarded so as to be visible to entrants in the area.

4. The apparatus of claim 1 wherein said first sensor means placed about the area to be guarded for detecting the presence and movements of entrants in the area and generating signals in response thereto include microphones to pick up noise from the movements of entrants in the area.

5. The apparatus of claim 1 wherein said sensor means placed about the area to be guarded for detecting the presence and movements of entrants in the area and generating signals in response thereto include television cameras to pick up the presence and movements of entrants in the area.

6. The apparatus of claim 1 wherein said first sensor means placed about the area to be guarded for detecting the presence and movements of entrants in the area and generating signals in response thereto include heat sensors to pick up the presence of entrants in the area.

7. The apparatus of claim 1 wherein said first sensor means placed about the area to be guarded for detecting the presence and movements of entrants in the area and generating signals in response thereto include pressure transducers to pick up the presence of entrants in the area.

8. The apparatus of claim 1 wherein said first sensor means placed about the area to be guarded for detecting the presence and movements of entrants in the area and generating signals in response thereto include motion sensors to pick up the presence of entrants in the area.

9. The apparatus of claim 1 wherein said at least one transmitter of radiant energy, for emitting into the area upon command from said operator station, includes a loud speaker.

10. The apparatus of claim 1 wherein said at least one transmitter of radiant energy, for emitting into the area upon command from said operator station, includes a whistle.

11. The apparatus of claim 1 wherein said at least one transmitter of radiant energy, for emitting into the area upon command from said operator station, includes a siren.

12. The apparatus of claim 1 wherein said at least one transmitter of radiant energy, for emitting into the area upon command from said operator station, includes an antenna.

13. The apparatus of claim 1 wherein said second sensor means, placed about the area to be guarded for detecting the onset of and intensity of the radiant energy broadcast into the area and generating signals in response thereto, include an audio receiver.

14. The apparatus of claim 1 wherein said second sensor means, placed about the area to be guarded for detecting the onset of and intensity of the radiant energy broadcast into the area and generating signals in response thereto, include a non-audio radiant energy receiver.

15. The apparatus of claim 1 wherein said first transfer means for transferring said generated signals from said first and second sensor means to said operator station include audio transfer lines.

16. The apparatus of claim 1 wherein said first transfer means for transferring said generated signals from said first and second sensor means to said operator station include video transfer lines.

17. The apparatus of claim 1 wherein said first transfer means for transferring said generated signals from said first and second sensor means to said operator station include fiber optics.

18. The apparatus of claim 1 wherein said second transfer means for transferring said generated signals from said first and second sensor means to said operator station includes shielded cable.

19. The apparatus of claim 1 wherein said radiant energy, capable of varying in strength and duration as to cause observable effects on entrants in the area, is acoustic energy.

20. The apparatus of claim 1 wherein said radiant energy, capable of varying in strength and duration as to cause observable effects on entrants in the area, is radio frequency (RF) energy.

21. The apparatus of claim 1 wherein said radiant energy, capable of varying in strength and duration as to cause observable effects on entrants in the area, is microwave energy.

22. The apparatus of claim 1 wherein said radiant energy, capable of varying in strength and duration as to cause observable effects on entrants in the area, is laser energy.

23. The apparatus of claim 1 wherein said radiant energy, capable of varying in strength and duration as to cause observable effects on entrants in the area, is X-Ray radiation.

24. Apparatus for achieving remote guarding of a plurality of areas each with adjustable effect on unauthorized entrants, comprising:

a) a plurality of first level operator stations, one for each area and arranged for manning by at least one operator, and a second level operator station, arranged for manning by at least one supervisor operator, in communication with said first level operator stations, said stations including a signal receiver with television display, radiant energy selection control, and energy level controller;

b) first sensor means placed about each area for detecting the presence and movements of entrants to the area, the visual effects of later radiation directed toward them, and generating signals in response thereto;

c) sources of radiant energy including at least one transmitter for each area of the energy for broadcasting said energy into each area, upon selection of the type of radiant energy from said selection control, and of a level controlled by said energy level controller, said radiant energy of a nature and intensity capable of varying in strength and duration as to cause different observable effects on intruders present in the area who do not leave the areas upon command;

d) second sensor means placed about each area for detecting the onset of and intensity of the radiant energy broadcast into that particular area and generating signals in response thereto;

e) first transfer means for transferring said generated signals from each said first sensor means and separately transferring said generated signals from said second sensor means to said signal receivers in their respective said first level operator stations and to said second level operator station to allow each operator real-time observation of their particular area; and, f) second transfer means for transferring control signals from said operator stations to said radiant energy sources and transmitters to vary the type and intensity of said radiant energy broadcast into the respective areas to prevent further intrusion into the areas.

25. The apparatus of claim 24 wherein said first sensor means are selected from the group consisting of microphones, television cameras, heat sensors, pressure transducers, motion sensors and mixtures thereof.

26. The apparatus of claim 24 wherein said transmitters are selected from the group consisting of loud speakers, whistles, sirens, antennas and mixtures thereof.

27. The apparatus of claim 24 wherein said second sensor means are selected from the group consisting of audio receivers, non-audio radiant energy receivers and mixtures thereof.

28. The apparatus of claim 24 wherein said first transfer means are selected from the group consisting of audio transfer lines, video transfer lines, optical fibers and mixtures thereof.

29. The apparatus of claim 24 wherein said energy sources are selected from the group consisting of acoustic energy, radio frequency energy, microwave energy, laser energy, X-Ray energy and mixtures thereof.

30. The process of achieving remote guarding of an area with adjustable effects on intruders, comprising the steps of:

a) remotely monitoring the area to be protected, through sensor means, to detect the presence of entrants into the area;

b) determining if said entrants are authorized to be in the area;

c) in the case where said entrants are not authorized to be in the area and are thus intruders, remotely activating a first, low level of radiant energy through transmitters into the area informing them that they have passed into a restricted area and directing them to leave the area immediately;

d) monitoring the area to detect if the intruders remain present in the area or have left the area;

e) in the case where the intruders have not left the area, remotely activating a second, higher level of radiant energy through transmitters located in the area in an effort to cause physical discomfort to the intruders and to urge them to vacate the area;

f) measuring and monitoring the area for the intensity of energy radiated therein to insure that excessive energy is not brought to bear on the intruders during their movement to leave the area;

g) monitoring the area to detect if the intruders are leaving or have left the area and, if they have not left the area, remotely checking to see if they have indicated movement toward any exit from the area; and, h) if the intruders have not left the area and are otherwise indicating by implication or otherwise their determination to remain in the area, then remotely activating a third, still higher level of radiant energy through transmitters located in the area of an intensity sufficient to disable the intruders and stop them from intruding further into the area.

31. The process of achieving remote guarding of an area with adjustable effects on intruders of claim 30 including the additional step of directing human guards into the area, following disablement of the intruders, to remove the intruders from the area and interrogate them.

32. The process of achieving remote guarding of an area with adjustable effects on intruders of claim 30 wherein the step of remotely activating a second, higher level of radiant energy through transmitters located in the area in an effort to cause physical discomfort to the intruders and to urge them to vacate the area is followed by the additional step of contacting a supervisor who has monitored all of the activity up to that point and requesting further instructions for dealing with the intruders.

* * * * *